US007352876B2

(12) United States Patent
Boor et al.

(10) Patent No.: US 7,352,876 B2
(45) Date of Patent: Apr. 1, 2008

(54) METHOD AND APPARATUS FOR SUBSTANTIALLY IMPROVING POWER SUPPLY REJECTION PERFORMANCE IN A MINIATURE MICROPHONE ASSEMBLY

(75) Inventors: Steven E. Boor, Plano, TX (US); Frank R. Mitchell, Park Ridge, IL (US)

(73) Assignee: Knowles Electronics, LLC., Itasca, IL (US)

( * ) Notice: Subject to any disclaimer, the term of this patent is extended or adjusted under 35 U.S.C. 154(b) by 444 days.

(21) Appl. No.: 10/834,317

(22) Filed: Apr. 28, 2004

(65) Prior Publication Data

US 2004/0252858 A1 Dec. 16, 2004

Related U.S. Application Data

(60) Provisional application No. 60/466,018, filed on Apr. 28, 2003.

(51) Int. Cl.
*H04R 25/00* (2006.01)

(52) U.S. Cl. ..... 381/174; 381/191; 381/189

(58) Field of Classification Search ..... 381/191, 381/174, 113, 176, 171, 189, 111, 112, 114, 381/115, 116, 170, 173, 175, 178, 322, 323, 381/324, 369, 190, 312; 307/170, 400
See application file for complete search history.

(56) References Cited

U.S. PATENT DOCUMENTS

| | | | | |
|---|---|---|---|---|
| 3,816,671 | A * | 6/1974 | Fraim et al. | 381/114 |
| 4,188,513 | A * | 2/1980 | Morrell et al. | 381/111 |
| 4,764,690 | A * | 8/1988 | Murphy et al. | 307/400 |
| 4,993,072 | A | 2/1991 | Murphy | |
| 5,362,927 | A | 11/1994 | Ezaki | |
| 5,408,534 | A * | 4/1995 | Lenzini et al. | 381/191 |
| 5,650,645 | A | 7/1997 | Sone et al. | |
| 5,650,665 | A | 7/1997 | Yamamoto et al. | |
| 6,084,972 | A | 7/2000 | Van Halteren et al. | |
| 6,243,474 | B1 | 6/2001 | Tai et al. | |
| 6,324,907 | B1 | 12/2001 | Halteren et al. | |
| 6,566,728 | B1 * | 5/2003 | Okawa et al. | 257/528 |
| 6,904,155 | B2 * | 6/2005 | Yonehara et al. | 381/174 |
| 7,239,714 | B2 * | 7/2007 | de Blok et al. | 381/369 |
| 2002/0071579 | A1 | 6/2002 | Himori et al. | |
| 2003/0202669 | A1 | 10/2003 | Boor | |

FOREIGN PATENT DOCUMENTS

| | | |
|---|---|---|
| EP | 0 800 331 A2 | 10/1997 |
| EP | 1 091 618 A2 | 4/2001 |

OTHER PUBLICATIONS

International Search Report for Application No. PCT/US2004/013011 dated Oct. 18, 2004.

* cited by examiner

*Primary Examiner*—Sinh Tran
*Assistant Examiner*—Joseph Saunders, Jr.
(74) *Attorney, Agent, or Firm*—Marshall, Gerstein & Borun LLP

(57) ABSTRACT

A hybrid circuit (300) for use in a miniature microphone assembly (100) reduces power supply noise on the audio signal input (214) of an impedance buffer amplifier (200) using one or both of shielding conductors 422, 424 to reduce parasitic capacitance between signal (418) and power supply (420) conductors. A ground plane (424), an interposing conductor (422) and combinations thereof are selectively placed and coupled to either ground (232) or a low impedance signal node (216) to reduce or eliminate the undesirable parasitic capacitance.

17 Claims, 5 Drawing Sheets

METHOD AND APPARATUS FOR SUBSTANTIALLY IMPROVING POWER SUPPLY REJECTION PERFORMANCE IN A MINIATURE MICROPHONE ASSEMBLY

CROSS-REFERENCE TO RELATED PATENT APPLICATIONS

This patent application claims the benefit of U.S. Provisional Patent Application No. 60/466,018, filed Apr. 28, 2003, the disclosure of which is hereby incorporated herein by reference in its entirety for all purposes.

TECHNICAL FIELD

This patent generally relates to improving the power supply rejection performance for miniature electret microphones used in listening devices, such as hearing aids or the like, and more particularly, to reducing inter-trace coupling capacitances associated with the conductors on a miniature microphone hybrid circuit assembly.

BACKGROUND

Hearing aid technology has progressed rapidly in recent years. Technological advancements in this field continue to improve the reception, wearing-comfort, life-span, and power efficiency of hearing aids. With these continual advances in the performance of ear-worn acoustic devices, ever-increasing demands are placed upon improving the inherent performance of the miniature acoustic transducers that are utilized. There are several different hearing aid styles known in hearing aid industry: Behind-The-Ear (BTE), In-The-Ear or All In-The-Ear (ITE), In-The-Canal (ITC), and Completely-In-The-Canal (CTC).

Generally, a listening device, such as a hearing aid or the like, includes a microphone assembly, an amplifier and a receiver (speaker) assembly. The microphone assembly receives vibration energy, i.e. acoustic sound waves in audible frequencies, and generates an electronic signal representative of these sound waves. The amplifier accepts the electronic signal, modifies the electronic signal, and communicates the modified electronic signal (e.g. the processed signal) to the receiver assembly. The receiver assembly, in turn, converts the increased electronic signal into vibration energy for transmission to a user.

The electronic signals generated in the microphone assembly are susceptible to interference, two examples of which are high frequency electromagnetic radiation interference from radio or cell phone transmitters in the range of 1-3 GHz, and power supply noise that is often caused when the receiver (speaker) draws substantial current from the miniature hearing aid battery. This disclosure is directed to the latter interference problem.

The impedance buffer circuit in a miniature electret microphone typically has a power supply rejection (PSR) performance of approximately 26 dB, which for hearing aid applications is considered rather poor immunity to power supply noise. Under noisy power supply conditions, which are quite common in high gain, miniature, hearing aid instruments, this poses a serious problem that is usually addressed by powering the microphone in the hearing aid from voltage regulator electronics having very high PSR. Typical hearing aid voltage regulators have approximately 50 dB of PSR, which improve the effective PSR of the microphone to approximately 75 dB in the hearing aid system. However, achieving this level of PSR in the microphone using a voltage regulator is undesirable for three reasons: it adds the voltage regulator to the bill of materials needed for hearing aid manufacturing, thus increasing the cost of hearing aid manufacture; it increases the power drain on the small hearing aid battery and reduces the battery lifetime; by adding to the number of parts required it makes the hearing aid harder to assemble, as well as taking up precious space within the miniature hearing aid shell.

Limitations of the microphone PSR performance come from limitations of the microphone buffer circuit itself, as well as from inter-trace stray capacitance limitations associated with the hybrid circuit. Since a typical electret transducer has a source capacitance on the order of 2 picoFarads ($10^{-12}$ F), 60 dB of PSR requires that these inter-trace stray capacitances from the buffer circuit input to the power supply remain one-thousandth of this or smaller, i.e. on the order of a femtoFarad ($10^{-15}$ F) or less. Reduction of inter-trace stray capacitance dramatically improves the performance of the overall listening device.

BRIEF DESCRIPTION OF THE DRAWINGS

For a more complete understanding of the disclosure, reference should be made to the following detailed description and accompanying drawings wherein.

DETAILED DESCRIPTION

Figure 1:
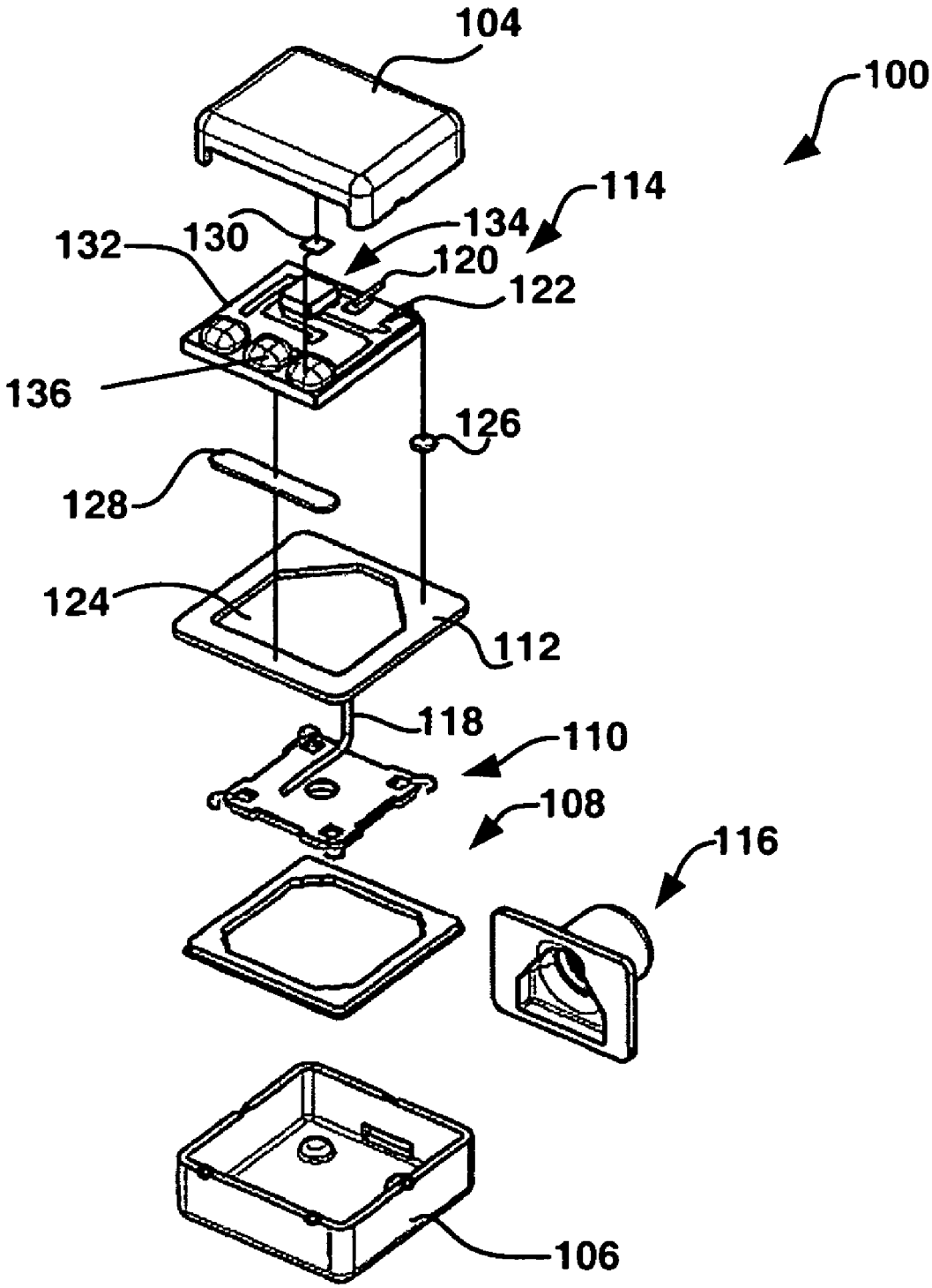
FIG. 1 is an enlarged exploded view of a microphone assembly.

While the present disclosure is susceptible to various modifications and alternative forms, certain embodiments are shown by way of example in the drawings and these embodiments will be described in detail herein. It will be understood, however, that this disclosure is not intended to limit the invention to the particular forms described, but to the contrary, the invention is intended to cover all modifications, alternatives, and equivalents falling within the spirit and scope of the invention defined by the appended claims.

The embodiments described herein provide a mechanism for reducing the inter-trace coupling capacitance of a microphone assembly circuit. The many features and advantages include providing a simple, low cost microphone assembly while maintaining high manufacturing yields, high field reliability, and exceptional product longevity.

The microphone assembly of a listening device includes a microphone, a preamplifier circuit, a radio frequency interference suppression device, an impedance buffer circuit, disposed primarily on a hybrid substrate, or simply, the substrate. The substrate has conductors disposed on it for carrying the electronic signals (audio) generated in the microphone, control signals, and power. When the conductors are physically close to each other on the same surface of the substrate the air separating the conductors can act as a dielectric to form a stray capacitor and couple signals from one conductor to the other. Similarly, when two conductors are disposed over the same ground plane, the dielectric of the substrate itself can form a stray capacitor and cause signal coupling. As described above, noise on the power supply conductor can be coupled by these stray capacitances to the signal input of the buffer circuit and reduce the power supply rejection of the overall circuit.

To address this undesirable coupling, several steps are proposed to reduce or remove the stray, or parasitic, capacitance between the conductors. One method is to place another conductor between the signal and power conductors. Another method is place the ground plane so that is does not overlap both the conductor carrying the audio signals and the conductor carrying power. A third method is to shield, after the manner of a coaxial cable, one of the conductors. These methods may be used separately or in combination.

Referring to FIG. 1, an enlarged exploded view of an example microphone assembly 100 is shown. The microphone assembly 100 includes a housing including a cover 104 and a cup or base 106. The microphone assembly 100 further includes a diaphragm assembly 108, a backplate assembly 110, a mounting frame 112, a preamplifier assembly 114, and a sound inlet port 116. The backplate assembly 110 is mounted to the diaphragm assembly 108. The combination of the backplate assembly 110 and the diaphragm assembly 108 constitute a variable capacitor to generate a representative electrical signal corresponding to a change in capacitance between the fixed electrode of the backplate assembly 110 and the movement in the diaphragm assembly 108 when exposed to acoustic waves or sonic energy.

A connecting wire 118 is fixedly attached to the backplate assembly 110 and electrically coupled to an input point 120 of the preamplifier assembly 114 via an opening 124 of the mounting frame 112. The preamplifier assembly 114 is grounded to the diaphragm assembly 108, the mounting frame 108, and the base 106 via a ground point 122.

To further reduce the sensitivity to low and high radio frequency interference signals, the preamplifier assembly 114 connects to the base 106 via the mounting frame 112 by means of the conductive adhesive 126, 128 to ground the RFI signals caused by communication devices. The preamplifier assembly 114 is further grounded to the cover 104 by means of a conductive coupling 130 such as an epoxy with suspended metallic flakes or spot welding. In particular, the conductive coupling 130 can be a two-part silver epoxy adhesive that provides high electrical conductivity and strong conductive bonding. Thus, the RFI present with the amplifier output signal supplied by the output connection 136 is suppressed. The mounting frame 112, the preamplifier assembly 114 and the cover 104 collectively create a back volume of air for the correct operation of the electret microphone.

The preamplifier assembly 114 may comprise a hybrid circuit 132 including an impedance buffer circuit 200 such as, for example, a source-follower field effect transistor (FET) integrated circuit 134 adapted to reduce the RFI, for example, RFI generated by communication devices. RFI suppression is detailed in co-pending U.S. Patent Application entitled "Microphone Assembly with Preamplifier and Manufacturing Method Thereof", filed on Mar. 26, 2004, herein incorporated by reference in its entirety for all purposes.

Figure 2:
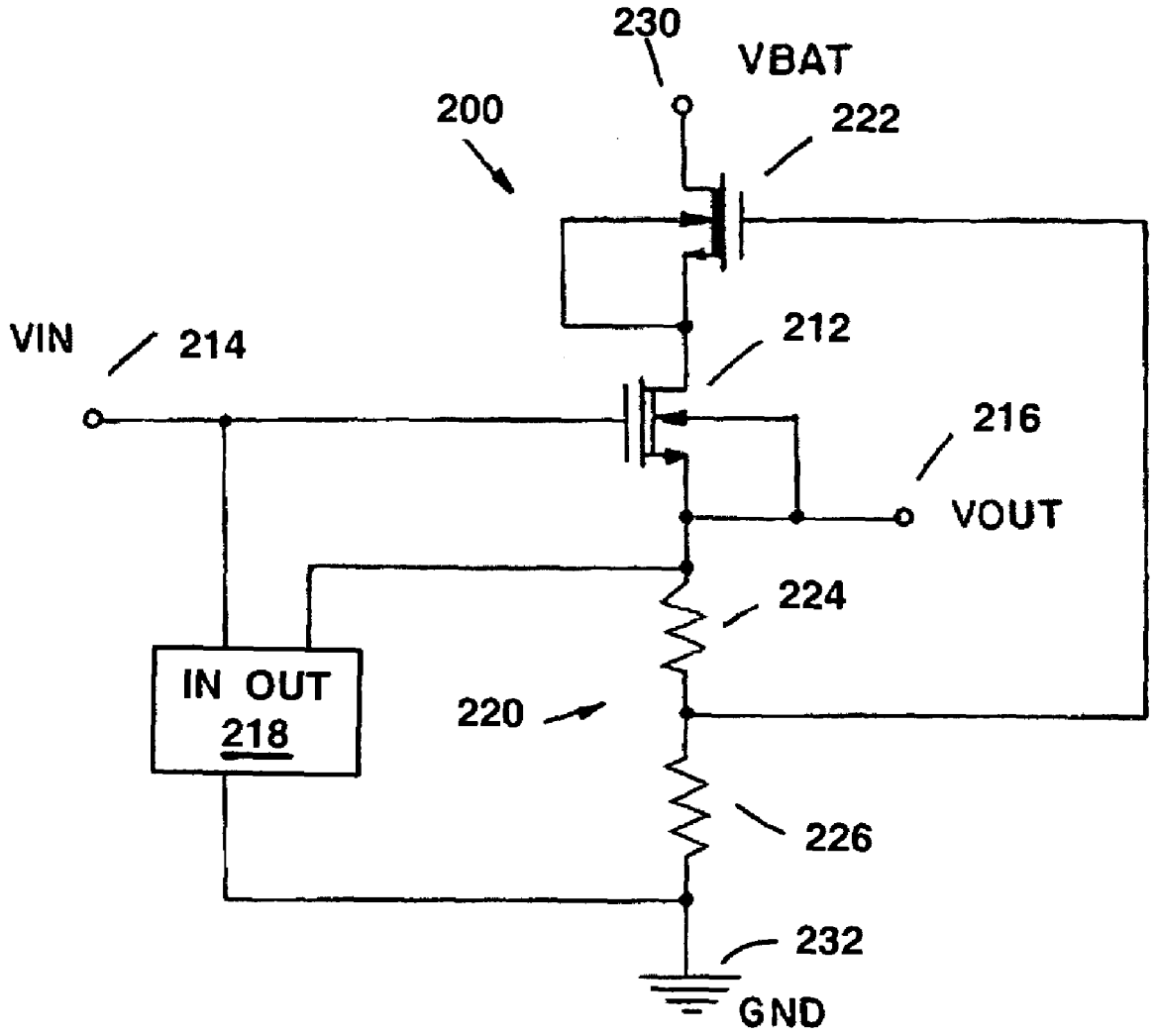
FIG. 2 is a buffer circuit for a microphone assembly.

FIG. 2 illustrates an impedance buffer circuit with 60 dB of power supply rejection (PSR) for the microphone assembly 100. The impedance buffer circuit 200 includes an input transistor 212 operably connected to an input ($V_{in}$) 214 and an output ($V_{out}$) 216. A power source ($V_{bat}$) is coupled at power connection 230. An input bias 218 is connected to the input ($V_{in}$) 214, the input transistor 212, and the output ($V_{out}$) 216. A voltage divider 220 is formed by first and second resistors 224, 226 and is coupled between the output ($V_{out}$) 216 and ground 232. The values of the divider resistors 224, 226 can be calculated by one of ordinary skill based on the exact transistors selected and circuit performance requirements. A transistor 222 such as a Depletion NMOS is incorporated into the circuit 200 to improve the overall PSR of the circuit 200. Other example impedance buffer circuits that may be used are disclosed in U.S. patent application Ser. No. 10/411,730, the disclosure of which is herein incorporated by reference in its entirety for all purposes.

With respect to FIGS. 3-7 various layout embodiments that increase the PSR performance of the microphone assembly 100 are described. Utilizing such techniques may improve PSR performance to the point where the voltage regulator mentioned above may not be needed to achieve the desired PSR performance in the miniature microphone assembly 100, resulting in a cost savings while increasing both battery life and reliability. Such techniques may also be used in addition to a voltage regulator.

The substrates 302, 612, 712 of the following embodiments may be a monocrystalline material such as sapphire or a sintered material such as aluminum oxide ($Al_2O_3$) or alumina. As alumina is relatively inexpensive and excels in high frequency performance among these available materials, high frequency devices use alumina substrates extensively. The substrate thickness and materials may vary depending on specific requirements of an application. The thickness of the alumina is usually between 225 μm and 275 μm, but is typically 250 μm. The substrates 302, 612, 712 are generally rectangular, having a geometry corresponding to the mounting frame 108. Other shapes and sizes may be used depending on the application.

The conductors formed on the substrate 302, for example, conductors 306, 308, 310, on the substrate 302 may be made of a conducting material, such as copper (Cu), silver (Ag), gold (Au), or the like, and may be sputtered or plated over the substrate 302 and etched into a desired pattern shape. The conductors might also be made of a screened-on and heat sintered conducting material, such as silver-platinum (AgPt) or silver-palladium (AgPd) alloy to define the desired pattern shape of the conductor; however, any conductive material or material including a conductive coating, such as thick copper may be utilized. When a silver alloy is used, it is generally screened-on and heat sintered, having a final thickness of 10 μm-14 μm, but may vary based on the requirements of a specific application.

Figure 3:
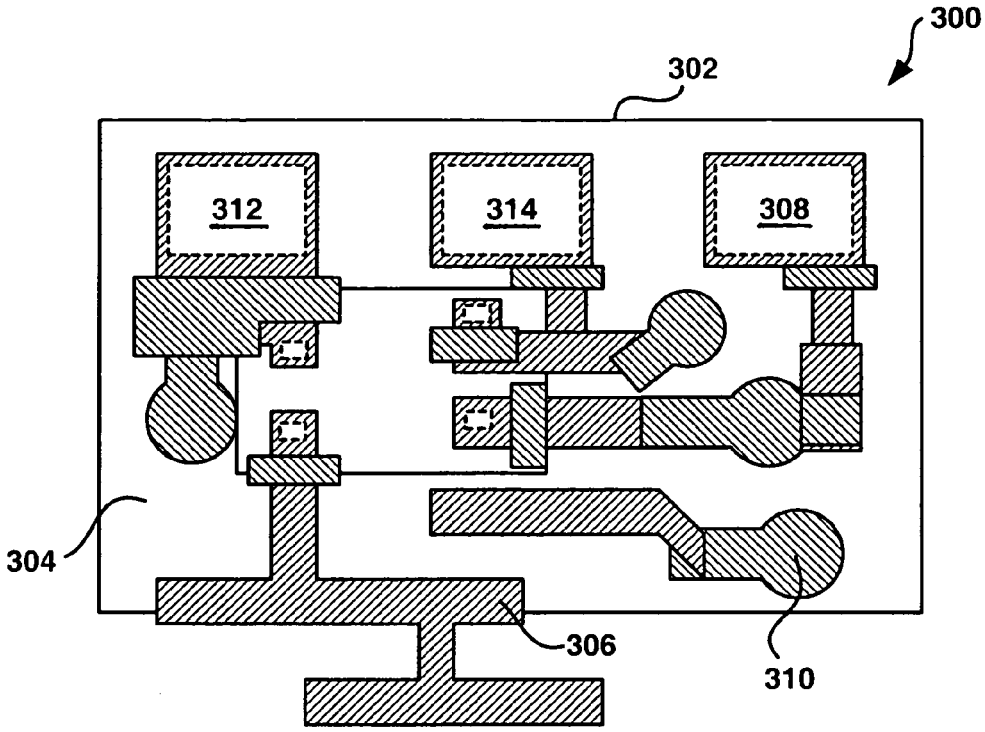
FIG. 3 is a plan view showing the top view of a hybrid circuit for a microphone assembly.

FIG. 3 is a top view of a hybrid circuit 300. The hybrid circuit 300 includes a substrate 302 having a first surface 304 and a second surface (not shown). A first conductor 306, a second conductor 308, and a shield conductor 310 are formed on the first surface 304 of the substrate 302. The first conductor 306 is operably connected to the input ($V_{in}$) 214 of the impedance buffer circuit 200. The second conductor 308 is operably connected to the power supply, such as the battery ($V_{bat}$) 230 of the impedance buffer circuit 200. The second conductor 308 may emit noise, such as, for example, undesirable power supply noise or other operational interference. To reduce or eliminate coupling of such noise to the first conductor 306, the shield conductor 310 is positioned between the first conductor 306 and the second conductor 308 to reduce the inter-trace coupling capacitance between them. The shield conductor 310 may be coupled to, for example, a ground node 312, a low impedance signal node, such as the signal output 314, etc. Doing so provides the advantages of reduced inter-trace coupling capacitance needed to achieve significantly improved PSR performance, high manufacturing yields, high field reliability, and exceptional product longevity.

Figure 4:
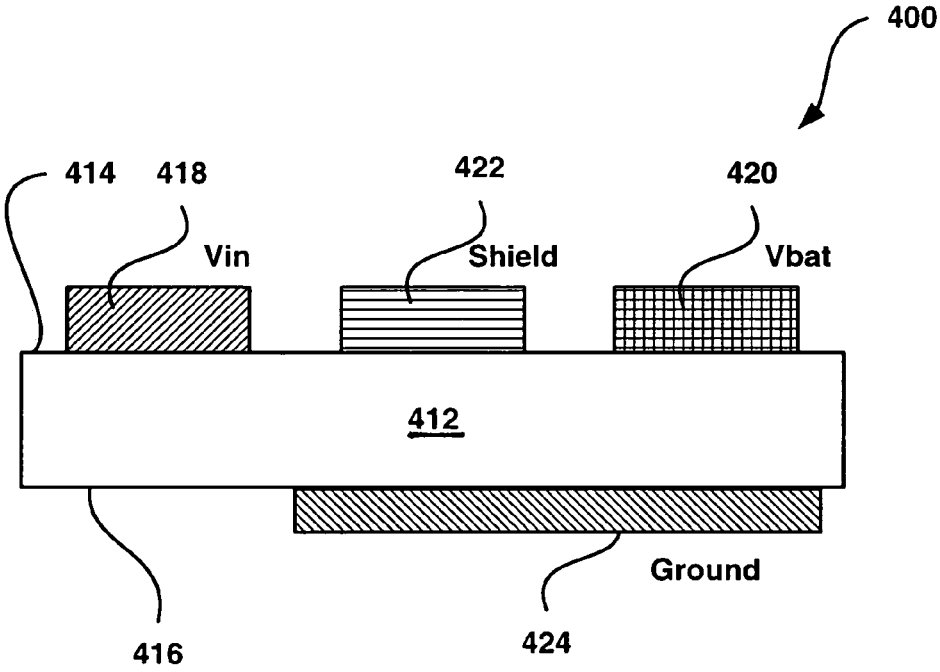
FIG. 4 is a cross-sectional view of the hybrid circuit of FIG. 3.
Figure 5:
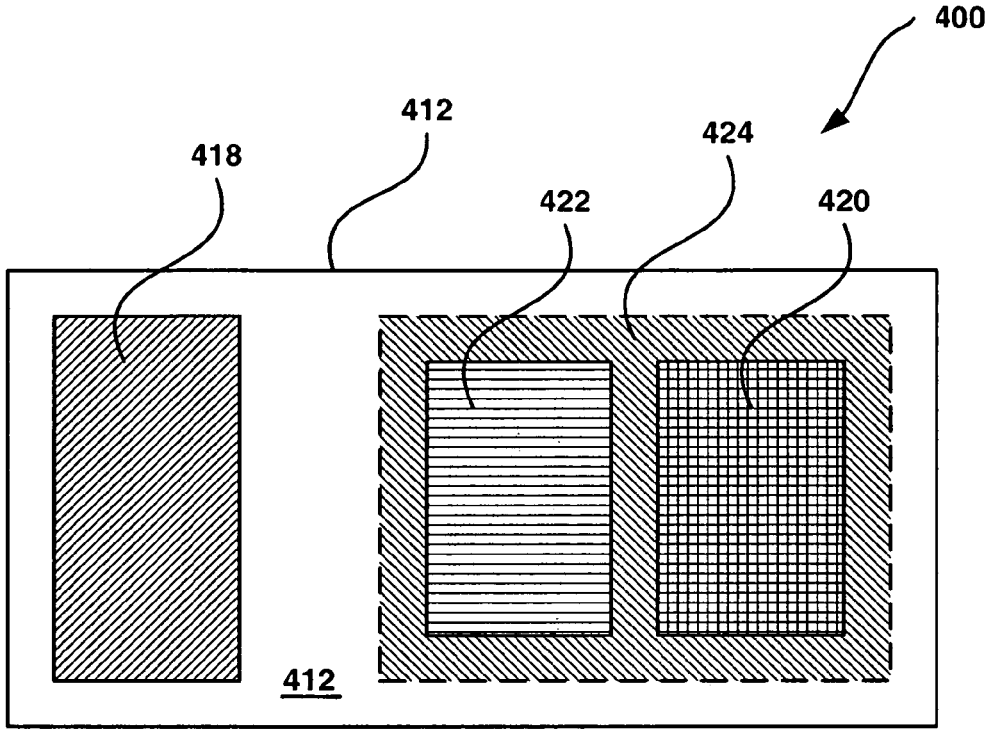
FIG. 5 is a top view of the hybrid circuit of FIG. 4.

FIGS. 4-5 are a representative cross-sectional view (FIG. 4) and a representative top view (FIG. 5) of a hybrid circuit 400 of similar fashion to that of FIG. 3. The entire layout of the hybrid circuit 400 is not shown in order to clarify explanation of the techniques to be used. A substrate 412 has first and second sides 414, 416 respectively, a plurality of conductors 418, 420, 422 and a ground plane 424. The ground plane 424 is formed on the second surface 416 of the substrate 412. The second conductor 420 and the shield conductor 422 are entirely overlapped by the ground plane 424 when viewed along an axis that is perpendicular to the first surface 414. The first conductor 418 may be operably connected to the input ($V_{in}$) 214 of the impedance buffer circuit 200, for example. The shield conductor 422 may be coupled, for example, to the circuit ground 122, a signal node such as the output 216 ($V_{out}$) of the microphone buffer circuit 200, etc. The third conductor 420 may be coupled to battery ($V_{bat}$) 230 of the impedance buffer circuit 200, for example. The ground plane 424 may serve as a ground and heat radiation material and may be operably connected, for example, by through-holes or vias in the hybrid circuit 400 to the ground connection 122 of the microphone assembly 100. The circuit elements mounted on the first surface 414 of the hybrid circuit 400 are shielded with respect to the ground plane 424 formed on the second surface 416 of the hybrid circuit 400. In this configuration, the parasitic capacitive loading on the first conductor 418 is reduced or eliminated due to the non-overlapping placement of the ground plane 424 and first conductor 418. Doing so provides the advantages of eliminated noise coupling through the inter-trace coupling capacitance of the hybrid circuit 400. The substantial elimination of this undesirable noise coupling can also be similarly achieved by configuring the ground plane 424 as a guard plane, that is, coupling the ground plane not to ground 122 but, for example, to a non-grounded low impedance signal node, such as the output 216 ($V_{out}$) of the microphone buffer circuit shown in FIG. 2. Other configurations of the conductors with respect to the ground plan will be apparent to one of ordinary skill in the art, as long as the shield conductor 422 and only one of the other conductors 418, 420 overlap the ground plane 424.

Figure 6:
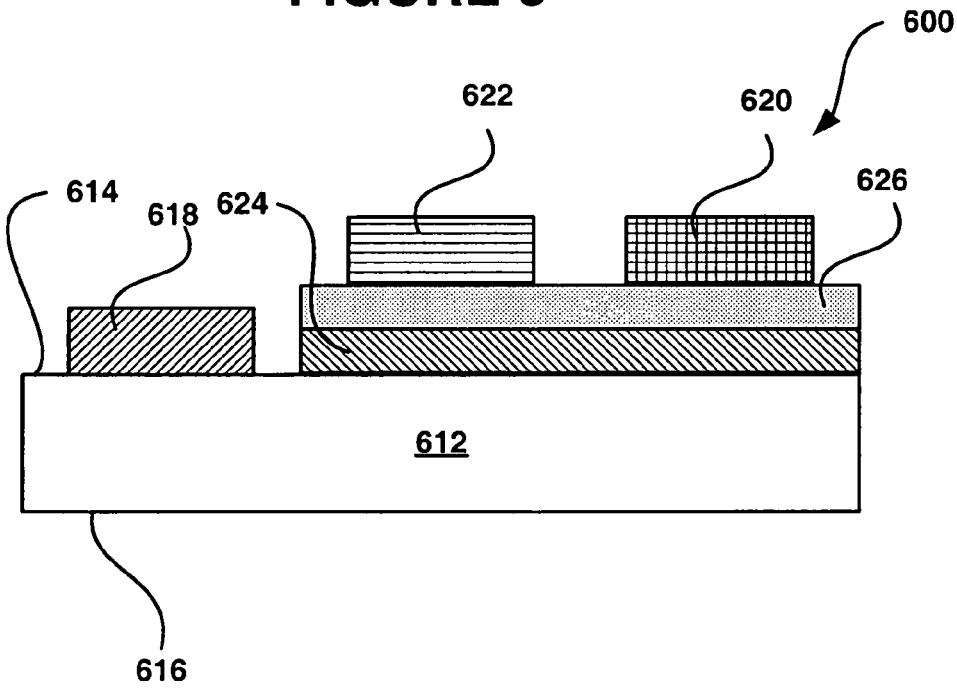
FIG. 6 is a cross-sectional view of another embodiment of a hybrid circuit for a microphone assembly.

Referring now to FIG. 6 a hybrid circuit 600 is discussed and described. The hybrid circuit 600 is similar in construction and function to the hybrid circuit 400 illustrated in FIGS. 4-5. The hybrid circuit 600 includes a substrate 612 having a first surface 614 and a second surface 616. At least one of a circuit pattern (not shown) is formed on the first surface 614 of the substrate 612.

A first conductor 618 and a ground plane 624, are formed on the first surface 614 of the substrate 612. An insulator is formed over the ground plane 624. The insulator 626 is typically screened-on as a liquid glass and then heat treated for solidification and densification to a final thickness of 10-14 μm. A second conductor 620 and a shield conductor 622 are formed on the upper surface of the insulator 626. The ground plane 624 may serve as both a ground and heat radiation material. The circuit elements (not shown) mounted on the first surface 614 of the hybrid circuit 600 are shielded by the ground plane 624 of the hybrid circuit 600. The first conductor 618 may be operably connected to the input ($V_{in}$) 214 of the impedance buffer circuit 200, for example. The shield conductor 622 may be operably connected to the output 216 ($V_{out}$) of the microphone buffer circuit or ground, for example. The second conductor 620 may be operably connected to the power supply, for example, the battery ($V_{bat}$) 230 of the impedance buffer circuit 200. The second conductor 620 may radiate noise, such as, for example, power supply noise or other operational interference, and via parasitic stray capacitance associated with the hybrid circuit 600. In this configuration, the parasitic capacitive loading on the first conductor 618 is reduced or eliminated due to the non-overlapping placement of the ground plane 624 and first conductor 618. Doing so may provide one or more of the following advantages; reduced inter-trace coupling of noise from the second conductor 620 to the first 618 resulting in improved PSR performance, high manufacturing yields, high field reliability, and exceptional product longevity.

Figure 7:
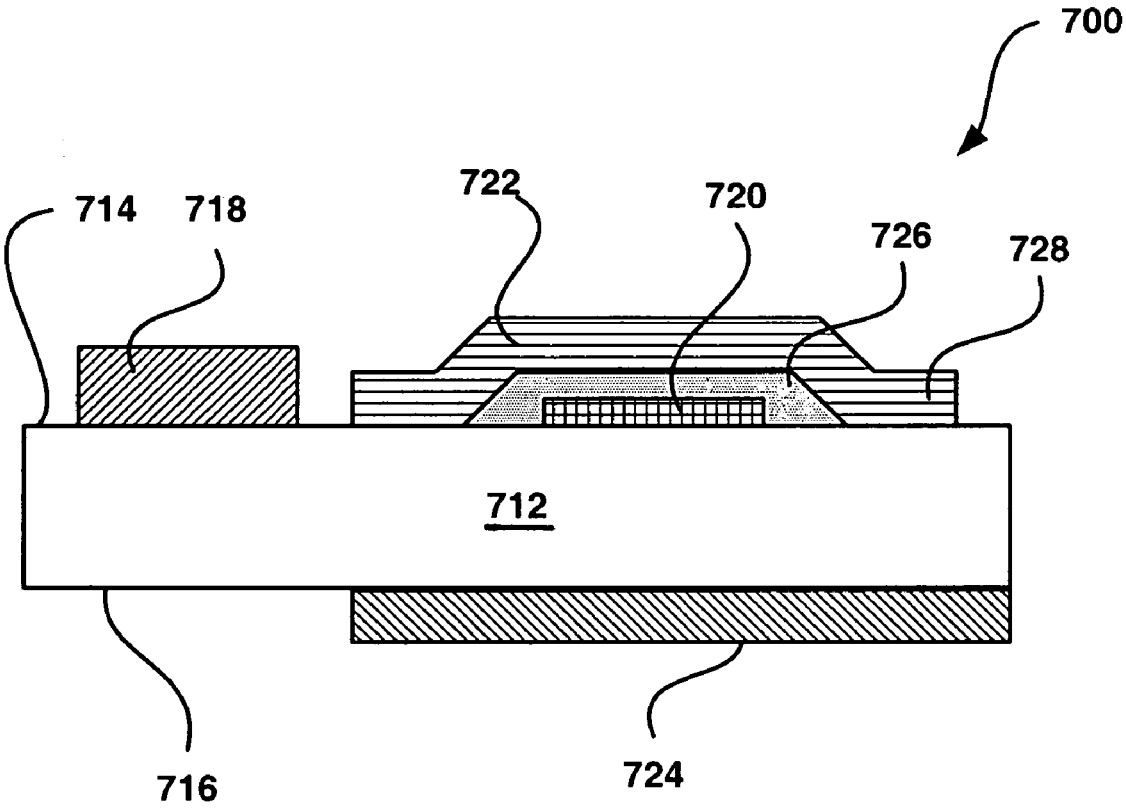
FIG. 7 is a cross-sectional view of yet another embodiment of a hybrid circuit for a microphone assembly.

Referring now to FIG. 7 a hybrid circuit 700 is discussed and described. The hybrid circuit 700 is similar in construction and function to the hybrid circuits 400 and 600 of FIGS. 4-6. The hybrid circuit 700 includes a substrate 712 having a first surface 714 and a second surface 716. At least one of a circuit pattern (not shown) is formed on the first surface 714 of the substrate 712.

As above, a first conductor 718 and a second conductor 720, are formed on the first surface 714 of the substrate 712. A ground plane, such as, for example, a ground or guard plane 724 just opposite the shield conductor 722, the second conductor 720, and the insulator 726 is formed on the second surface 716 of the substrate 716. An insulator 726 is screened-on and heat sintered as above. The shield conductor 722 is formed over the insulator 726 and attached to the first surface 714 of the substrate 712 by means of footings 728. The ground plane 724 may serve as a ground and heat radiation material. The circuit elements (not shown) mounted on the first surface 714 of the hybrid circuit 700 are shielded by the ground plane 724 of the hybrid circuit 700. The first conductor 718 may be operably connected to the input ($V_{in}$) 214 of the impedance buffer circuit 200, for example. The shield conductor 722 may be operably connected to a low impedance signal node, for example, the output 216 ($V_{out}$) of the impedance buffer circuit 200. The second conductor 720 may be operably connected to the power supply, for example, the battery connection ($V_{bat}$) 230 of the impedance buffer circuit 200. The second conductor 720 may radiate noise, such as, for example, power supply noise or other operational interference, and via parasitic stray capacitance associated with the hybrid circuit. In this configuration, the parasitic capacitive loading on the first conductor 718 may be reduced or avoided due to the shielding effect of the shield conductor 722. Doing so may provide one or more of the following advantages; reduced inter-trace coupling of noise from the second conductor 720 to the first 718 resulting in improved PSR performance, high manufacturing yields, high field reliability, and exceptional product longevity. However, it will be understood by those or ordinary skill in the art that any form of shielding technique would suffice, such as, for example, using coaxial shield techniques, "noisy" conductors can be completely surrounded with a lower impedance ground or low-noise guard.

It is to be understood that the ground plane 424, 724 on the second surface 416, 716 of the substrate 412, 712 can be conveniently connected in common with the shield conductor 422, 722, especially when the impedance buffer circuit is flip-chip attached to the hybrid circuit 400, 700. It will be clear that alternative variations and modifications of the example of embodiment described are also suitable for shielding or guarding the above detrimental parasitic capacitances, such as, for example, laying a shield or guard conductor substantially over "noisy" power supply conductor paths with an insulator between them. Other variations, such as, for instance, using a coaxial shield techniques, "noisy" conductors can be completely surrounded with a lower impedance ground or low-noise guard.

The protective guard conductors, shield conductors, and/or ground planes should avoid creating excessive parasitic loading capacitance upon the extremely sensitive impedance buffer input node, since that would result in an undesirable loss in sensitivity for the overall microphone assembly due to capacitive divider effects. As such, the spacing, or overlap, of the protective conductors or planes should be such that inter-trace coupling to conductors connected to the impedance buffer input results in a minimal amount of capacitive loading thereof.

The parasitic coupling reduction methods of the present invention are also capable of being implemented whenever other "noisy," non-power supply related signals are present in a preamplifier assembly, e.g. digital clock signals, mixed-mode signals such as a charge pump output, or other digital signals. Utilizing techniques such as those described above should help reduce the amount of interference or noise from such non-power supply sources that is injected into the highly sensitive impedance buffer circuit input of a microphone assembly.

Several advantages and benefits of the example techniques have been described. It is to be understood that some implementations may not provide any of the advantages described herein, but may provide other advantages or benefits not described herein.

All references, including publications, patent applications, and patents, cited herein are hereby incorporated by reference to the same extent as if each reference were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A miniature microphone assembly comprising:

a substrate having a first surface and a second surface opposite the first surface, the substrate being an insulator;

a conductive plane disposed on one of the first and second surfaces, the conductive plane partially covering the one of the first and second surfaces;

a first conductor disposed on the first surface to be non-overlapping with the conductive plane, the first conductor to couple to an audio signal associated with the microphone assembly;

a second conductor disposed on the insulator, the second conductor overlapping with the conductive plane, the second conductor to couple to a power source for the microphone assembly; and a shield conductor disposed on the insulator, the shield conductor overlapping the conductive plane, the shield conductor disposed between the first and second conductors.

2. The miniature microphone assembly of claim 1 wherein the shield conductor is coupled to one of a circuit ground and a low impedance signal node of a buffer circuit.

3. The miniature microphone assembly of claim 1 further comprising:

an insulating layer disposed on one of the first and second conductors; and the shield conductor is disposed on the insulating layer, the shield conductor at least partially encapsulating the one of the first and second conductors.

4. The miniature microphone assembly of claim 1 wherein the conductive plane is disposed on the second surface and the first and second conductors are disposed on the first surface.

5. The miniature microphone assembly of claim 1 comprising an insulating layer disposed on the conductive plane, and the conductive plane is disposed on the first surface.

6. The miniature microphone assembly of claim 5 wherein the shield conductor is disposed on the insulating layer overlapping the conductive plane.

7. The miniature microphone assembly of claim 1 wherein the conductive plane is coupled to a circuit ground.

8. The miniature microphone assembly of claim 1 wherein the substrate is one of sapphire, aluminum oxide, and alumina.

9. The miniature microphone assembly of claim 1 wherein the substrate is alumina having a thickness between 225 μm and 275 μm.

10. A method of manufacturing a hybrid circuit for use in a miniature microphone assembly comprising:

providing a substrate, the substrate having a first surface and a second surface opposite the first surface;

disposing a first conductor on the first surface, the first conductor for coupling a signal associated with an electret audio transducer;

disposing a second conductor on the first surface, the second conductor for coupling to a power source of the miniature microphone assembly;

disposing a third conductor between the first and second conductors to reduce a parasitic capacitance between the first and second conductors, the third conductor coupled to one of a ground node and a low impedance signal node of a buffer amplifier;

disposing a conductive plane on the substrate such that the conductive plane overlaps the second and third conductors and does not overlap the first conductor, the conductive plane separated from the second and third conductors by an insulator; and coupling an integrated circuit comprising an impedance buffer circuit to the substrate and one of the first and second conductors.

11. The method of claim 10 further comprising disposing the conductive plane on the second surface wherein the insulator is the substrate.

12. The method of claim 10 further comprising:

disposing the conductive plane on the first surface; and disposing an insulating layer over the conductive plane, wherein the insulating layer is the insulator and the second and third conductors are disposed on the insulating layer.

13. The method of claim 10 wherein the disposing the third conductor further comprises disposing the third conductor on the first surface.

14. The method of claim 10 wherein the disposing the third conductor further comprises:

disposing an insulating layer over one of the first and second conductors; and disposing the third conductor over the insulating layer to completely overlap the one of the first and second conductors by the third conductor.

15. A hybrid circuit for use in a miniature microphone assembly comprising:

a substrate having a first surface and a second surface opposite the first surface, the substrate being an insulator;

a first conductor, disposed on the first surface, the first conductor for coupling to an electret audio transducer;

a second conductor, disposed on the first surface, the second conductor to couple to a power source of the miniature microphone assembly;

a ground plane disposed to overlap the second conductor and not overlap the first conductor; and a shield conductor, disposed on the first surface, the shield conductor disposed between the first and second conductors and overlapping the ground plane.

16. The hybrid circuit of claim 15 further comprising:

an insulating layer disposed over one of the first and second conductors to encapsulate the one of the first and second conductors; and the shield conductor disposed over the insulating layer, the shield conductor coupled to one of a circuit ground and a low impedance signal node of an impedance buffer.

17. The hybrid circuit of claim 15 wherein the substrate is alumina having a thickness between 225 μm and 275 μm.

* * * * *